United States Patent [19]

Wackerbarth

[11] 4,306,939

[45] Dec. 22, 1981

[54] METHOD OF OPERATING A COKE OVEN BATTERY

[75] Inventor: Folkard Wackerbarth, Bochum, Fed. Rep. of Germany

[73] Assignee: Dr. C. Otto & Comp. G.m.b.H., Bochum, Fed. Rep. of Germany

[21] Appl. No.: 111,151

[22] Filed: Jan. 11, 1980

[30] Foreign Application Priority Data

Aug. 16, 1979 [DE] Fed. Rep. of Germany ..... 2933069

[51] Int. Cl.[3] ..... C10B 21/10

[52] U.S. Cl. ..... 201/1; 202/141; 202/151

[58] Field of Search ..... 201/1, 41; 202/141, 202/142, 143, 144, 151; 364/496, 497, 500

[56] References Cited

U.S. PATENT DOCUMENTS

| | | | |
|---|---|---|---|
| 3,556,947 | 1/1971 | Kumper | 201/1 |
| 3,607,660 | 9/1971 | Kumper | 202/151 X |
| 4,045,292 | 8/1977 | Matsushita et al. | 201/1 |
| 4,080,434 | 3/1970 | Buss et al. | 422/150 X |
| 4,086,143 | 4/1978 | Echterhoff et al. | 201/41 |
| 4,141,797 | 2/1979 | Pries et al. | 201/41 |

OTHER PUBLICATIONS

Weskamp, W., Dressler, W. and Frenzel, H. *Warmeleistungsregelung bei der Beheizung von Koksofen,* in Gluckauf. 101 (22), pp. 1292–1297, Oct. 27, 1965.

*Primary Examiner*—Frank W. Lutter
*Assistant Examiner*—Roger F. Phillips
*Attorney, Agent, or Firm*—Thomas H. Murray; Clifford A. Poff

[57] ABSTRACT

Regenerative changeover of a coke oven battery is designed for operation according to a method wherein each regenerative half period is broken down into a time when gas is supplied at a constant pressure to the burners in heating flues and a time when no gas is supplied. A final control facility acts on the regenerative changeover facility to enable the regenerative half period to be broken down into these two time periods. A controller is responsive to variations in gas properties, such as the calorific value, density, humidity and temperature, to bring about operation of the final control element so that the heating time and the pause in every regenerative half period have values such that the heat supplied to the battery in each half period remains constant.

10 Claims, 6 Drawing Figures

METHOD OF OPERATING A COKE OVEN BATTERY

BACKGROUND OF THE INVENTION

This invention relates to a method of operating a battery of coke ovens with regenerative heat exchange between gaseous combustion agents, and more particularly to such a method wherein properties of the gas supplied for heating are measured continuously such as the calorific value, density, humidity and temperature which affect the quantity of heat evolved by combustion of the gas, and a controller operates to minimize the effect of variations of such properties of the gas on the operation of the coke oven battery.

One known method of operating a coke oven battery is shown in Gluckauf 1965, pages 1292–1297. This known method provides that the operation of the coke oven battery occurs by increasing the operating pressure of the gas supplied for combustion in the event of a variation to the property of the gas which reduces the heat of combustion. The gas pressure is reduced in the event of a variation to the property of the gas which tends to increase the heat of combustion.

In a coke oven battery, branch lines extend from gas supply lines to various burners. The branch lines usually have different baffles to insure that the heating gases are so distributed to all the heating flues, i.e., along the length of the heating walls, so that the contents of the oven chambers are heated uniformly. Similar baffles are provided in the gas branch lines extending to the various heating walls from the gas distribution line which extends along the coke oven battery to insure that a uniform supply of gas is provided to all the heating walls.

Unfortunately, the required uniform distribution of gas occurs only at one particular overall operating pressure of the heating gas. Any departure from this specific operating pressure alters the heating gas distribution even though the baffles in the gas supply lines remain at the same size or setting. A deviation from the specific gas pressure brings about the result that the burners, heating walls and heating flues fail to provide uniform heating to the various parts of the contents in the coke oven chambers. The values or settings of the baffles in the various gas supply branch lines will, therefore, have to be altered to insure that in the event of an alteration to the gas supply pressure, the various parts of the oven chamber content will nevertheless continue to be heated uniformly.

SUMMARY OF THE INVENTION

It is an object of the present invention to provide a method of operating a battery of coke ovens wherein the amount of heat supplied to the coke oven battery is maintained constant by an automatic facility, notwithstanding variations to the properties of the supply of heating gas and without changes to the setting or position of baffles in the gas supply lines which distribute gas to the various burners.

According to the present invention, a method of operating a battery of coke ovens is provided wherein regenerative heat exchange occurs between gaseous combustion agents during regenerative half periods, the gas for combustion being supplied to burners in heating flues arranged in heating walls between oven chambers of the coke oven battery, the method includes the steps of continuously measuring properties of gas affecting the quantity of heat evolved by combustion of the gas in the heating flues, arranging a facility for regenerative changeover of the battery to divide each regenerative half period into a first period for feeding gas to the burners for combustion in the heating flues between each oven chamber and a second time period for discontinuing the supply of gas to such burners, using a final control to operate the regenerative changeover facility to define a desired division to each regenerative half period by the durations of the first and second time periods, and using a controller to operate the final control to adjust the duration of the first time period in response to measurements produced by the continuously measuring of properties of the gas to develop a constant quantity of heat during each regenerative half period.

Thus, according to the present invention, the facility for regenerative changeover of the battery is operated so that each regenerative half period can be broken down into a time during which gas is supplied to the burners and a time during which no gas is supplied, i.e., a pause. A final control facility operates on the changeover facility and enables the regenerative half period to be broken down into these two time periods. The controller is responsive to variations in the gas properties and operates on the final control element to control the change-over facility in response to variations in the properties of the gas so that the heating time and the pause in every regenerative half period have values such that the heat supplied to the battery in each half period remains constant.

To initiate the pause, the facility for regenerative changeover of the battery first operates to close the gas valves and shortly thereafter, for example, operates to reduce the chimney draft to a very low level by moving a flue gas restrictor in the connecting line between the common waste gas flue and the chimney into a position in which there is a reduced draft on the common waste gas flue. It is necessary that the controller only respond to such properties as the calorific value, density, humidity and temperature of the heating gas as may be determined by the experience of a considerable variation to such properties. The occurrence of such variations to the properties of the gas depends upon the operating conditions of the coke oven plant, i.e., upon the kind of gas supplied. If, for example, a rich-gas supply is a mixture of gases having different origins, such as coke oven gas, mine damp and residual synthesis gas, and if the ratio of the gas components of the mixture alters frequently, considerable variations, at least to the calorific value, are likely to occur. When a gas supply is derived from a coke oven plant, the properties of the gas are varied and altered when coking coals having different water contents and characteristics undergo degassing by the operation of the plant.

Consequently, to maintain the heat supplied to the battery of coke ovens in each regenerative half period constant, the effect to which variations to the heating gas properties have on the heat output must be measured.

The main difference in the operating principle from the known method of operating a battery of coke ovens described above and the operating method of the present invention is that the pressure of the gas, according to the present invention, remains constant during each regenerative half period. The operating pressure of the gas is determined during a regenerative half period when the pause is zero so that the heat output required for the shortest coking time is determined on the basis of the most disadvantageous properties of the gas that is to be fired and likely to arise in practice. The calorific value, density, humidity, etc. are properties of the gas which affect the heat output. This basis for operating the battery of coke ovens insures that the heat required during a regenerative half period is supplied to the battery.

These features and advantages of the present invention as well as others will be more fully understood when the following description is read in light of the accompanying drawings, in which.

Figure 1:
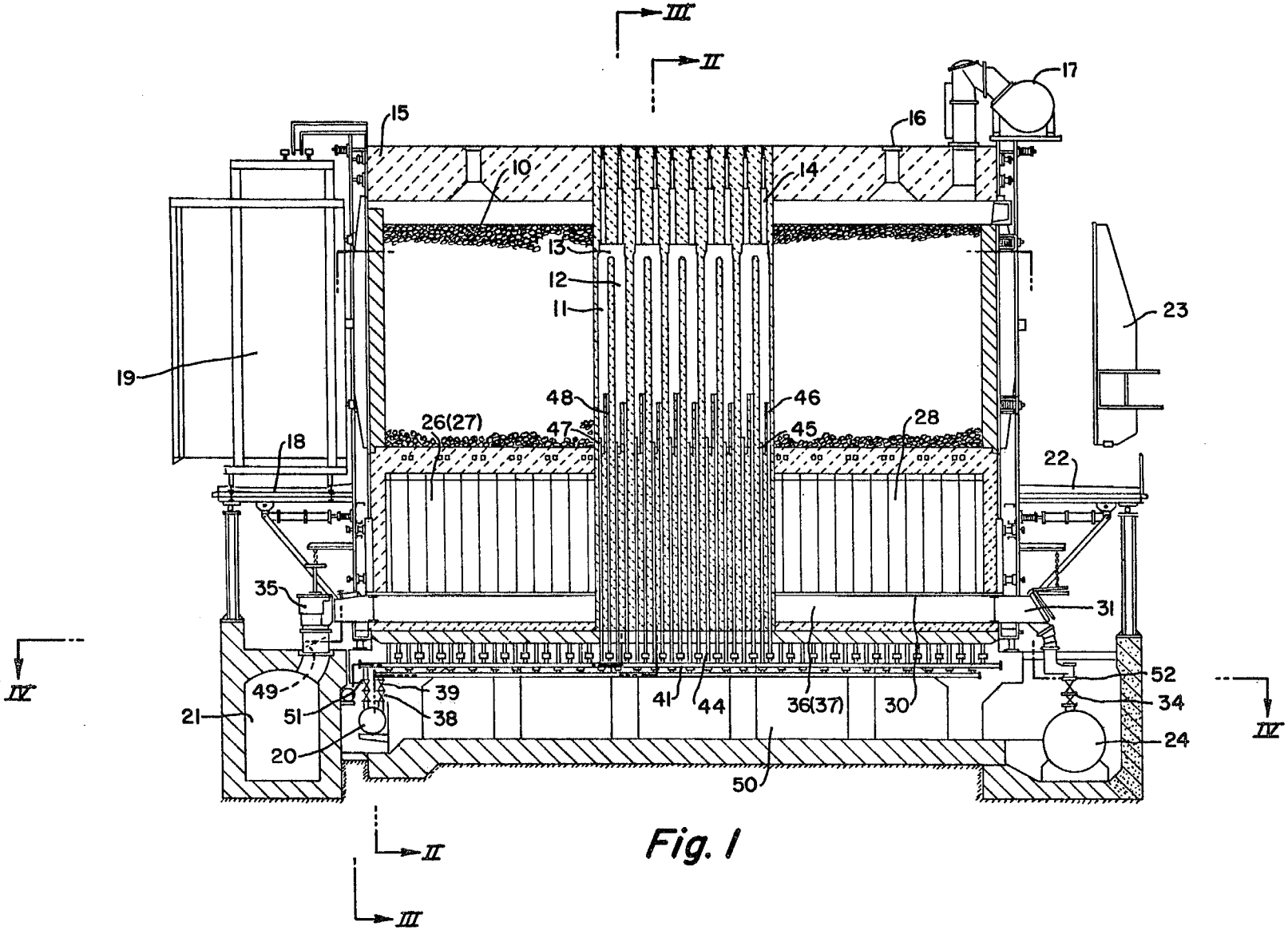
FIG. 1 is an elevational view, partly in section, through a row of heating flues and partly in section through a coke oven chamber.
Figure 4:
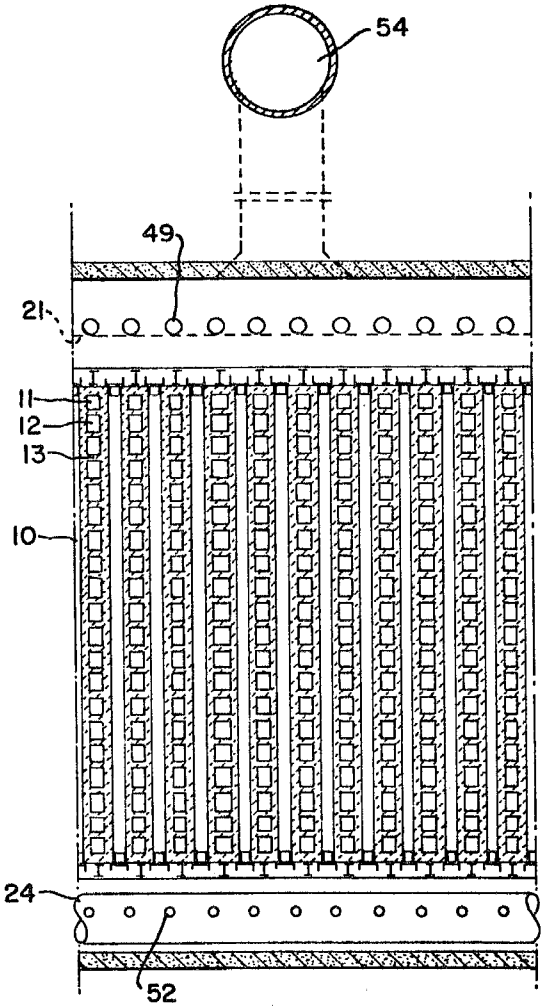
FIG. 4 is a sectional plan view taken along line IV—IV of FIG. 1.

The method of operating a battery of coke ovens according to the present invention can be carried out with any well-known forms of coke oven batteries. The coke oven battery construction chosen for the purpose of disclosing the present invention is the same as the coke oven battery disclosed in U.S. Pat. No. 4,141,797, issued to the Assignee of this invention and disclosing a different method of operating a battery of coke ovens.

As shown in FIGS. 1–4, a battery of coke ovens includes horizontal coke oven chambers 10 extending alternately between rows of heating flues 11 and 12. The heating flues are defined in the heating walls between the coke oven chambers. In each heating wall, the heating flues are in the form of twin-flues formed by crosswalls which define the up-burning flue 11 connected to the down-burning flue 12 by a top aperture 13. The direction of burning is reversed when the direction of draft on the flues is reversed at regenerative half periods or regular intervals. Inspection holes in the oven crown 15 are used for observing the operation and combustion in the heating flues. Coking coal is introduced through charging holes 16 in the oven crown. The gases liberated during the carbonization process of the coking coal in the oven chambers are delivered by ascension pipes to a collecting main 17 extending along the coke oven battery.

A charging floor 18 (FIG. 1) extends along the coke side of the battery for supporting a coke-guide machine 19. The coke-guide machine supports coke guides, a door-handling machine, a door cleaner and a door frame cleaner. A rich-gas distribution main 20 and a collector flue 21 for flue gas also extend along the coke oven battery at the coke side.

A ram head 23 of a coke pushing ram is driven by a coke pushing machine which is movable along the charging floor 22 at the machine side of the coke oven battery. A lean-gas distribution main 24 extends along the coke oven battery at the machine side.

Figure 3:
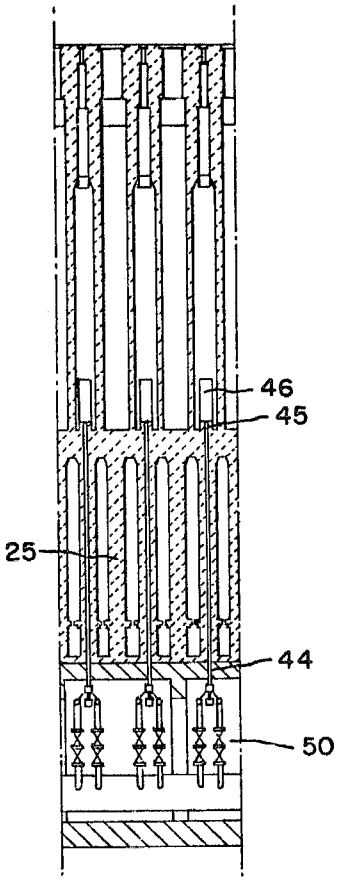
FIG. 3 is a sectional view taken along line III—III of FIG. 1.
Figure 2:
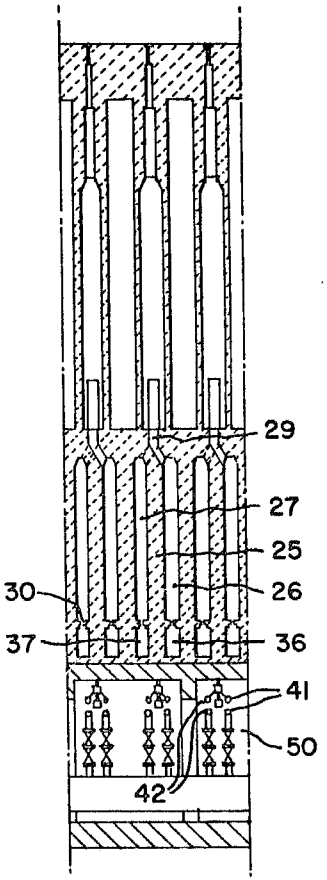
FIG. 2 is a sectional view taken along line II—II of FIG. 1.

Regenerator partitions 25 are disposed below the coke oven chambers. A pair of regenerators 26 and 27, connected to the regenerator sole flues 36 and 37, is disposed between each of the vertical central planes of the oven chambers. Crosswalls 28 subdivide the regenerators 26 and 27 into individual cells. As shown in FIGS. 2 and 3, each regenerator cell is connected to a heating flue in a row thereof disposed at the left side of the regenerator cell and a heating flue in a row disposed at the right side of the regenerator cell. A control member 30 is disposed in each of the openings provided between a regenerator sole flue 36 or 37 and one of the cells of the regenerator 26 or 27. The details of the construction of the control members 30 are shown in the aforesaid U.S. Pat. No. 4,141,797. The control members 30 extend below the bottom checkerbrick of a regenerator cell. The control members include metal frames having lateral bars bearing against the walls of the regenerator sole flue 36 or 37. The top plate of the frame includes apertures which can be closed to a desired extent by a damper plate having corresponding apertures. The damper plate can be adjusted longitudinally of the sole flue by means of a pin. This form of control element is shown in U.S. Pat. No. 3,969,191 which is assigned to the same Assignee as the present invention. However, other forms of control elements may be employed.

When a pair of regenerators 26 and 27 receives gas along its entire length in an ascending direction, the two adjacent pairs of regenerators 26 and 27 receive gas in a downward direction. In this type of connection between individual regenerator cells with flues of two adjacent rows of heating flues, it follows that if in one heating flue row, the first flue burns upwards and the second flue burns downwards, the direction of flow is reversed in the two adjacent heating flues, i.e., in the successive heating flue rows the succession of upwardly and downwardly burning heating flues alternate from row-to-row.

When the coke oven battery is operated on rich-oven gas, the two regenerators 26 and 27 are alternately used for preheating the combustion-supporting air and for absorbing the heat from the burnt gases discharged from the flues. When the coke oven battery is operated for heating by lean gas, the regenerators 26 and 27 are used for alternately preheating the lean gas.

Air is supplied to the regenerator sole flues 36 and 37 by air slides 31 actuated by a reversing winch disposed at the end of the regenerator sole flues. The regenerator sole flue 36 includes a lean-gas feed connected to a lean-gas distribution main 24 by values 34 actuated by the reversing winch. Associated with values 34 are oven curtains as shown in the aforesaid U.S. Pat. No. 4,141,797. The regenerator sole flues 37 have only one air feed slide 31. At the coke side of the coke oven battery, all the regenerator sole flues 36 and 37 are connected by waste gas heat valves to the flue gas collecting main 21.

Rich gas is supplied from the rich-gas distribution main 20 through check valves 38, reversing valves 39 and oven curtains employed to control the individual pipe strand through nozzle pipes 41 and 42 that extend along the basement 50. The pipes 41 receive rich gas during one regenerative half period and pipes 42 receive rich gas during the other regenerative half period. Calibrated nozzles control the flow rate of rich gas from pipes 41 and 42 into ascension pipes 44 which extend along in regenerator partitions 25 to nozzles 45, 46, 47 and 48. The nozzles 45–48 extend upwardly to varying heights within the heating flue 11 and 12 as shown in FIG. 1.

Throttle valves 49 are disposed between the waste-heat valves 35 and the flue gas collecting main 21. These throttle valves provide the means by which the chimney draft on the gas collecting main 21 is distributed to the individual regenerator sole flues.

To obtain uniform heating of all the coke oven chambers in the battery when heating is achieved by rich gas, air slides 31 are first adjusted and then adjustments to valves 34 for controlling the supply of lean gas, and adjustments to control members 30 are effected. As pointed out previously, the control members 30 are disposed between the regenerator sole flues 36 and 37 and the individual cells of the lean-gas regenerators 26 and the air regenerators 27. As can be readily understood in light of the foregoing, the control members 30 are operative for metering both upward and downward burning of the gaseous media. This media enters from the two adjacent regenerator cells of the regenerators 26 and 27 in which the media to be preheated rises. The media then enters the heating flue of an adjacent heating flue row. The burnt gases pass downwardly in a regenerator cell of an adjacent pair of regenerators 26 and 27 and then under the influence of control members 30, the burnt gases enter a pair of regenerator sole flues 36 and 37 and then these gases enter the flue gas collecting main 21 when the waste-heat valve 36 is open. The throttle valves 49 disposed between the waste-heat valve 35 and the flue gas collecting main 21 must also be correctly or properly adjusted.

Figure 6:
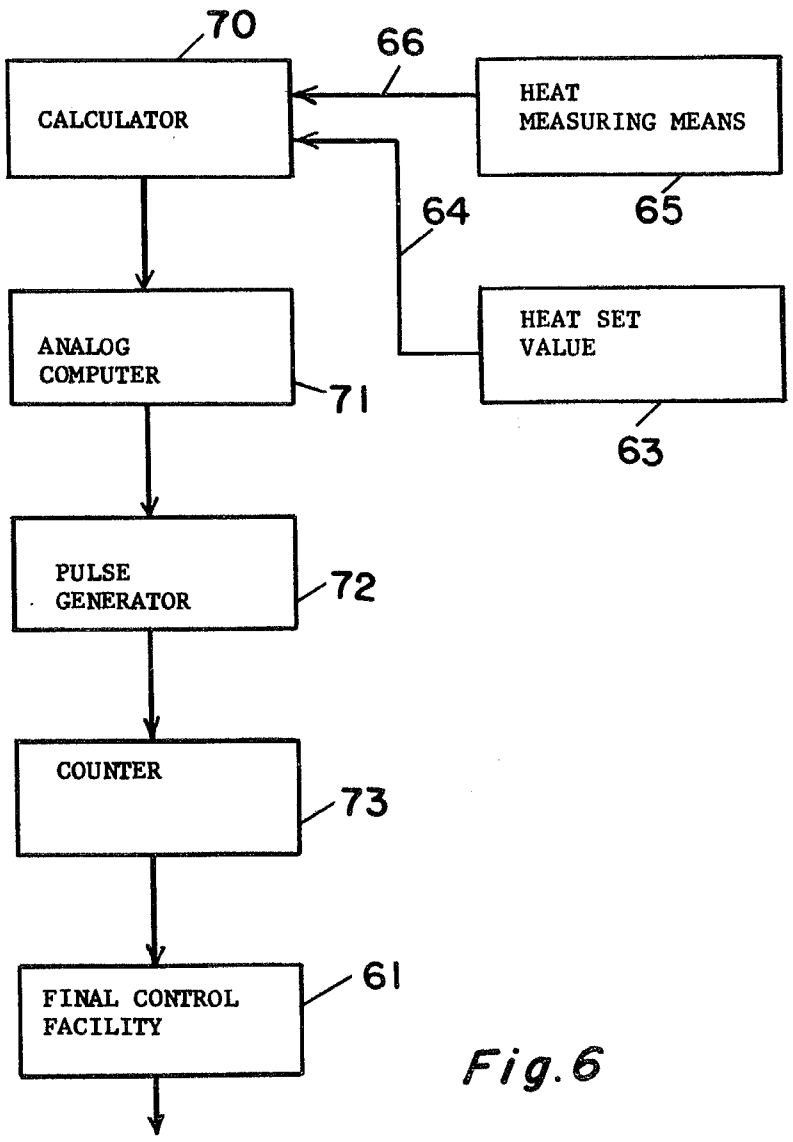
FIG. 6 is a block diagram similar to FIG. 5 but illustrating one arrangement of specific control components.
Figure 5:
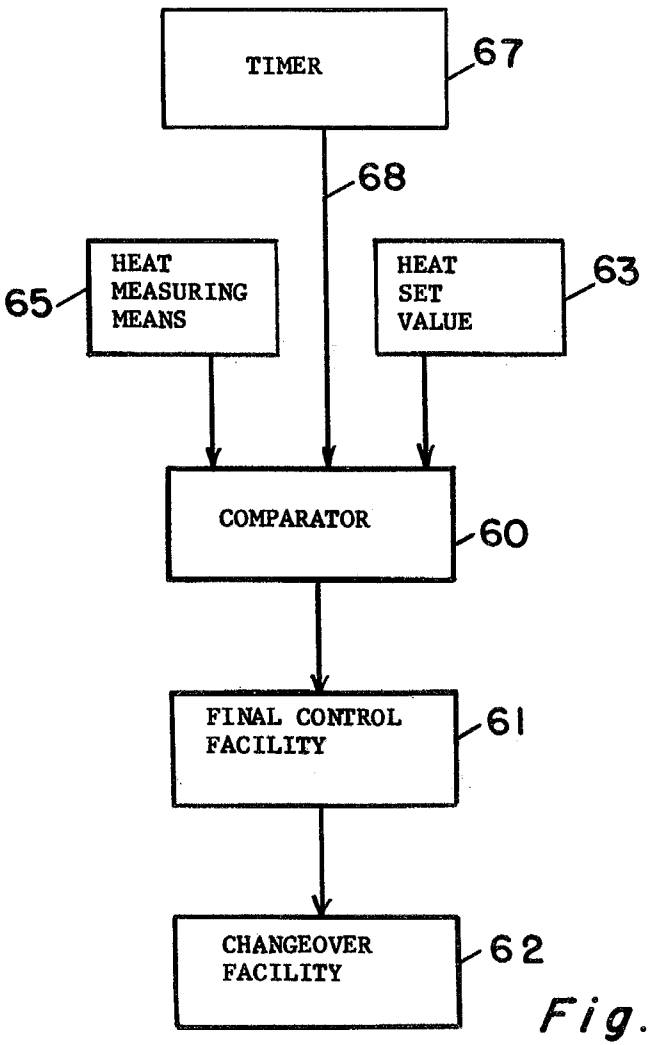
FIG. 5 is a simplified block diagram illustrating one form of control principle to carry out the method of the present invention.

As described previously, the operating pressure at which gas is supplied to the coke oven battery is controlled so that the pressure is constant during each regenerative half period. The pressure of the gas for combustion is determined during a regenerative half period when the pause is zero. The heat output required for the shortest coking time is determined on the basis of the most disadvantageous properties of the gas. Such properties typically include the calorific value, density, humidity and the like for the gas which is to fired and variations to these properties are likely to arise during the period of operation of the coke oven battery. This insures that the heat required during the regenerative half period is supplied by combustion of the gas. As shown in FIG. 5, a comparator 60 is coupled to operate on a final control facility 61 used to actuate a changeover facility 62. Inputs to the comparator include a suitable signal generator 63 providing a signal in line 64 corresponding to a desired set value for the amount of heat required during each regenerative half period. A heat measuring means 65 provides a signal in line 66 corresponding to the measured quantity of heat produced during each regenerative half period. A timer 67 is set to provide a signal in line 68 corresponding to the duration of a regenerative half period. After a pulse is set by the timer via line 68 to the comparator, the timer is reset by a reset signal and, at the same time, a reset signal is delivered to the heat measuring means 65. The comparator compares the set value with the actual value provided by the signal in line 66 formed by an integrated series of heat measurements. When the actual value has reached the set value, comparator 60 delivers a signal to final control facility 61 which energizes the changeover facility 62 for operation to a pause time in each regenerative half period. At the end of each regenerative half period, the heat measuring means and timer are reset to zero and the changeover facility is actuated by a signal for supplying heat during the succeeding regenerative half period. FIG. 6 illustrates one arrangement of control apparatus to bring about the control as just described in regard to FIG. 5. In FIG. 6, the heat measuring means 65 delivers output signals in line 66 to a calculator 70 which also receives a signal from generator 63 in line 64 corresponding to a set value for the heat output during each regenerative half period. The set value for the heat output is adjusted to suit requirements. The calculator 70 is coupled to an analog computer 71 which, in turn, delivers output signals to a pulse generator 72. The pulse generator delivers pulsed signals to a counter 73 which delivers a control signal to the final control facility 61. The pickups which measure the heat output provide signals corresponding to variations of the heat output from the required mean value and thereby define the various properties of the heating gas. It is to be understood that the heat output required for the battery of coke oven chambers may vary in operation when coals, for example, having different properties, particularly a different water content, are supplied to the battery for coking operation. In such an event, the set value for the heat output must be altered. According to a further feature of the present invention, the set value can be altered automatically by the action of set value controllers in the event of variations in the battery operating conditions as determined by temperature measurements and supplied to the appropriate adjusting means by computers.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A method of operating a battery of coke ovens with regenerative heat exchange between gaseous combustion agents during regenerative half periods, the gas for combustion being supplied to burners in heating flues arranged in heating walls between oven chambers of the coke oven battery, said method including the steps of continuously measuring properties of gas affecting the quantity of heat evolved by combustion of gas in the heating flues, feeding the gas at a substantially constant operating pressure to burners for combustion in the heating flues between each oven chamber during a first time period of each regenerative half period, discontinuing the supply of gas to such burners during a second time period of each regenerative half period, and controlling said first time period of response to measurements produced by said continuously measuring properties of gas to develop a constant quantity of heat during each regenerative half period.

2. A method of operating a battery of coke ovens with regenerative heat exchange between gaseous combustion agents during regenerative half periods, the gas for combustion being supplied to burners in heating flues arranged in heating walls between oven chambers of the coke oven battery, said method including the steps of continuously measuring properties of gas affecting the quantity of heat evolved by combustion of the gas in the heating flues, arranging a facility for regenerative changeover of the battery to divide each regenerative half period into a first time period for feeding the gas at a substantially constant operating pressure to burners for combustion in the heating flues between each oven chamber and a second time period for discontinuing the supply of gas to such burners, using a final control to operate the regenerative changeover facility to define a desired division to each regenerative half period by the durations of said first and second time periods, and using a controller to operate on said final control to adjust the duration of said first time period in response to measurements produced by said continuously measuring properties of gas to develop a constant quantity of heat during each regenerative half period.

3. The method according to claim 2 wherein said step of continuously measuring properties of gas includes measuring the calorific value of the gas.

4. The method according to claim 2 wherein said step of continuously measuring properties of gas includes measuring the pressure of the gas.

5. The method according to claim 2 wherein said step of continuously measuring properties of gas includes measuring the density of the gas.

6. The method according to claim 2 wherein said step of continuously measuring properties of gas includes measuring the humidity of the gas.

7. The method according to claim 2 including the further steps of producing a set value signal corresponding to a desired quantity of heat to be developed during each regenerative half period, producing an actual value signal corresponding to a measured value of heat produced during the same regenerative half period, and feeding said set value signal and said actual value signal for use by said controller to operate on said final control.

8. The method according to claim 7 wherein said actual value signal is derived from a signal delivered from an analog computer to a pulse generator coupled to a counter to provide an integrated output corresponding to measurements of various calorific values of gas.

9. The method according to claim 2 including the further step of maintaining the operating pressure of the gas supplied to the coke oven battery constant.

10. The method according to claim 2 wherein said step of continuously measuring includes measuring temperatures of the combustion of gas to form a command variable signal, and wherein said method includes a step of producing an adjustably selected set value signal corresponding to a desired amount of heat to be supplied during each regenerative half period.

* * * * *